US005187404A

United States Patent [19]

Straub

[11] Patent Number: 5,187,404

[45] Date of Patent: Feb. 16, 1993

[54] SURFACE GAP IGNITER

[75] Inventor: Stephen W. Straub, Easley, S.C.

[73] Assignee: Cooper Industries, Inc., Houston, Tex.

[21] Appl. No.: 739,973

[22] Filed: Aug. 5, 1991

[51] Int. Cl.[5] ..... H01T 13/20; H01T 13/02

[52] U.S. Cl. ..... 313/131 A; 313/130; 313/131 R; 361/253

[58] Field of Search ..... 313/131 R, 131 A, 130; 123/169 EL, 169 PA; 361/247, 253, 255

[56] References Cited

U.S. PATENT DOCUMENTS 2,684,665 7/1954 Tognala ..... 313/131 R X
3,108,905 10/1963 Comer ..... 313/131 R X
3,558,959 1/1971 Ziemendorf ..... 313/131 R X
3,883,762 5/1975 Harris et al. ..... 313/131 A X
4,951,173 8/1990 Suzuki et al. ..... 313/131 A X

*Primary Examiner*—Donald J. Yusko
*Assistant Examiner*—Ashok Patel
*Attorney, Agent, or Firm*—William Bruce Patterson; Nelson A. Blish; Alan R. Thiele

[57] ABSTRACT

An improved low voltage igniter of the type having an annular spark gap between a center electrode and annular ground electrode which is arranged coaxial with the center electrode. The spark gap is shunted by an insulator surface. Semiconducting material is deposited on the insulator surface as one or more rings which are coaxial with and spaced from the electrodes. The semiconducting rings reduce the voltage required to initiate a spark across the spark gap.

6 Claims, 1 Drawing Sheet

SURFACE GAP IGNITER

TECHNICAL FIELD

The invention relates to spark igniters used in gas turbine engines such as aircraft jet engines and more particularly to a surface gap igniter having at least one semiconductive ring deposited on an insulator surface at the spark gap to facilitate sparking at a lower voltage.

BACKGROUND ART

One type of gas turbine engine igniter design has a ceramic surface extending between a center electrode and a ground electrode at a spark gap. The ground electrode is annular and coaxial with the center electrode. An ignition system supplies high energy high voltage pulses to the igniter. The system may include a capacitor which is charged as an applied voltage increases. When the voltage in the capacitor becomes sufficiently large to cause a spark discharge at the igniter, the energy stored in the capacitor is discharged to the spark gap. The fuel igniting spark travels over the ceramic surface at a spark gap.

Because of weight considerations in the aircraft industry, various techniques have been employed to reduce the voltage needed to produce a spark of the required energy and thereby to reduce the size and weight of the ignition system. The size and weight of the ignition system can be reduced by reducing the voltage requirement of the igniter. One way to reduce the igniter's voltage requirement is to place a semiconducting ceramic insert across the spark gap or to apply a semiconducting or engobe surface coating on the insulator at the spark gap. This establishes a large value resistance in parallel with the spark gap which is lower than the resistance of air. Consequently, a spark of the required energy will occur at a lower voltage. While decreasing the voltage needed to initiate a spark discharge in an igniter, a semiconducting or engobe surface coating can cause certain problems at the spark gap. For example, the semiconducting or engobe coating is prone to wear under normal use. One type of engobe is produced by adding sufficient metallic copper powder or copper dioxide to an electrically insulating glaze to obtain the desired resistivity. Under severe conditions, a spark gap surface completely coated with such an engobe can become elemental copper, resulting in a short circuit between the electrodes. Accordingly, there is a need for an igniter having a longer lasting semiconducting coating on the ceramic which is less likely to breakdown into a short circuit across the spark gap under harsh operating conditions.

DISCLOSURE OF INVENTION

According to the invention, an igniter is formed with an annular spark gap between a center electrode and a coaxial ground electrode spaced from the center electrode. The spark gap is shunted by an electrically nonconducting ceramic surface so that sparks formed between the electrodes creep over the ceramic surface. One or more concentric rings of a semiconducting ceramic material are embedded in the ceramic surface coaxial with and spaced from the center and ground electrodes. The semiconducting rings lower the electrical potential required to initiate sparking. However, unlike prior art igniters wherein the entire surface is coated with a semiconducting ceramic, if severe operation conditions cause any or all of the semiconducting rings to become electrically conductive, the igniter will continue to function Since the spark gap will not be entirely shunted by a conductor.

Accordingly, it is an object of the invention to provide an improved igniter of the type having an annular spark gap shunted by a semiconducting surface along which sparks travel to reduce the ignition voltage requirements, but which is not subject to failure if the semiconducting surface breaks down and becomes electrically conductive.

Other objects and advantages of the invention will be apparent from the following detailed description and the accompanying drawings.

BEST MODE FOR CARRYING OUT THE INVENTION

Figure 1:
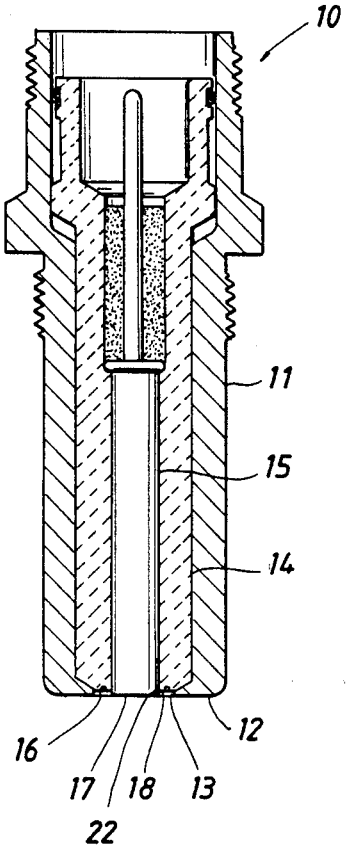
FIG. 1 is a cross sectional view through an exemplary igniter embodying the invention.

An igniter 10 of a type commonly used for jet aircraft engines is shown in FIG. 1. The igniter generally includes a tubular metal shell 11 having a firing end 12 which forms an annular ground electrode 13. A ceramic insulator 14 mounted in the shell 11 supports a center electrode 15. A spark gap 16 is formed between a side 22 of the center electrode 15 and the ground electrode 13. The spark gap 16 is shunted by an end surface 18 on the insulator 14.

In operation, a spark travels across the gap 16 along the insulator end surface 18 when the voltage between the center electrode side 22 and the ground electrode 1 is sufficient to overcome the resistance of the air and of any deposits on the end surface 18. To lessen the electrical resistance between the center electrode end 17 and the ground electrode 13, it is known that semiconducting ceramic glaze may be applied over the insulator end surface 18. The coating is of an engobe material and is selected to have a resistance effective to reduce the required spark voltage to a predetermined low level such as between 1,000 and 3,000 volts.

Figure 2:
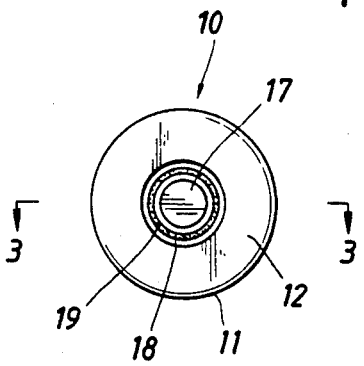
FIG. 2 is an end view of the igniter of FIG. 1.
Figure 3:
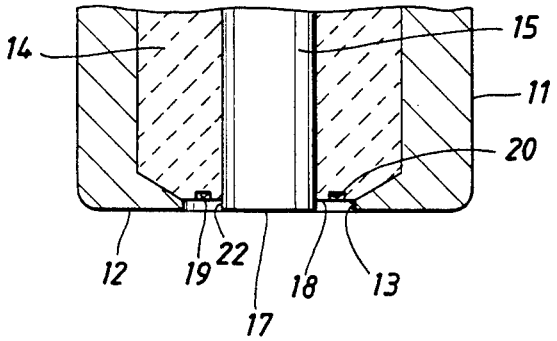
FIG. 3 id an enlarged fragmentary cross sectional view taken along line 3—3 of FIG. 2.

Referring to FIGS. 2 and 3, a semiconducting coating is applied as an annular layer 19 spaced from and coaxial with the center electrode end 17 and the ground electrode 13. The coating layer 19 may be formed, for example, from a conventional electrically nonconductive glaze doped with a conductive material such as a metallic copper powder, copper dioxide or chrome oxide to provide the desired resistance between the electrodes 15 and 13. Or, the layer 19 may consist of a semiconducting silicon carbide ceramic insert in the insulator end 18 spaced from the center electrode side 22 and from the ground electrode 13, for example, of a silicon nitride or glass bonded silicon carbide, as is known in the spark plug and igniter art. The semiconducting coating may be applied to the insulator end 18 in any desired depth. However, the preferred depth is between 0.025 mm (0.001 inch) and 0.77 mm (0.030 inch). As is best seen in FIG. 3, the coating layer 19 preferably is located in an annular groove 20 in the insulator 14 and extends flush with the insulator end surface 18.

During operation of the igniter 10, two sparks will occur in series across the spark gap 16 each time the igniter 10 is pulsed. A first spark will occur between the center electrode side 22 and the coating layer 19, the spark will creep over the surface of the coating layer 19 and a second spark will occur between the coating layer 19 and the ground electrode 13. The coating layer 19 may be relatively wide to reduce the voltage required for a spark discharge. However, the exposed insulator end surface 18 extends completely around the center electrode end 17 between the center electrode end 17 and the coating layer 19 and between the coating layer 19 and the ground electrode 13. The exposed insulator end surface 18 functions to prevent a direct short circuit between the center electrode end 17 and the ground electrode 13 in the event that severe operating conditions cause the semiconducting layer 19 to become electrically conductive.

Figure 4:
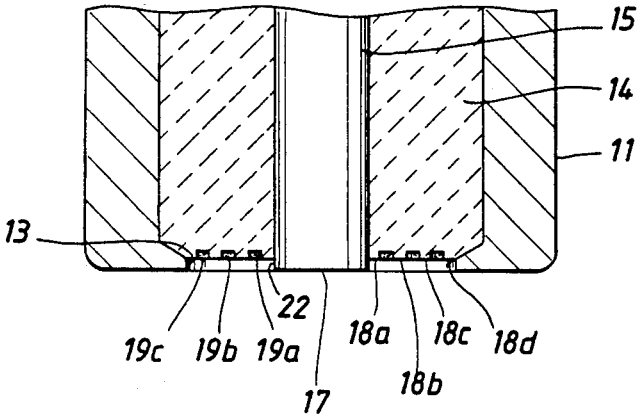
FIG. 4 is an enlarged fragmentary cross sectional view similar to FIG. 3, but showing a modified embodiment of the invention.

FIG. 4 illustrates a modification of the igniter 10 in which a plurality of annular semiconducting layers are formed on the insulator end surface 18, with three layers 19*a*, 19*b* and 19*c* illustrated. The insulator end surface 18 has an annular surface portion 18*a* location between the center electrode end 17 and the semiconducting layer 19*a*, an annular surface portion 18*b* located between the semiconducting layers 19*a* and 19*b*, an annular surface portion 18*c* located between the semiconducting layers 19*b* and 19*c*, and an annular surface portion 18*d* located between the semiconducting layer 19*c* and the ground electrode 13. Preferably, a uniform spacing is provided between the adjacent ones of the center electrode end 17, the layers 19*a*, 19*b* and 19*c* and the ground electrode 13. The semiconducting layers 19*a*–19*c* reduce the voltage required to establish a spark discharge, while the insulator end surface portions 18*a*–18*d* allow the igniter 10 to continue to spark in the event that severe operating conditions cause a breakdown of one or more of the semiconducting layers 19*a*–19*c* to an electrically conductive material.

It will be appreciated to those skilled in the igniter art that various modifications and changes may be made to the above described specific igniter embodiments without departing from the spirit and the scope of the invention.

I claim:

1. An igniter comprising:

a generally tubular shell;

an insulator mounted within said shell;

a center electrode mounted within an axial bore through said insulator, said center electrode having a firing end forming one side of a spark gap;

an annular ground electrode coaxial with said center electrode forming a second side of said spark gap;

said insulator having a firing end extending between said electrodes across said spark gap; and at least one semiconducting layer means on said insulator firing end extending around said center electrode and spaced from both of said electrodes and not physically contacting both of said electrodes, said semiconducting layer means reducing the voltage required to establish a spark discharge across said spark gap.

2. An igniter, as set forth in claim 1, wherein said semiconducting layer means is coaxial with said center electrode.

3. An igniter, as set forth in claim 2, wherein said semiconducting layer means consists of a coating on said insulator firing end formed into at least two spaced rings coaxial with said client electrode.

4. An igniter, as set forth in claim 3, wherein adjacent ones of said at least two speed rings and said electrodes are uniformly spaced.

5. An igniter, as set forth in claim 4, wherein said semiconducting layer means has a thickness of between 0.025 mm and 0.77 mm.

6. An igniter, as set forth in claim 1, wherein said semiconducting layer means has a thickness of between 0.025 mm and 0.77 mm.

* * * * *